US005692614A

United States Patent [19]

Harris

[11] Patent Number: 5,692,614

[45] Date of Patent: Dec. 2, 1997

[54] ARTICLE CARRIER WITH BOTTOM PANEL FALSE SCORE

[75] Inventor: Randall L. Harris, Powder Springs, Ga.

[73] Assignee: Riverwood International Corporation, Atlanta, Ga.

[21] Appl. No.: 605,387

[22] Filed: Feb. 23, 1996

[51] Int. Cl.[6] ..... B65D 65/00

[52] U.S. Cl. ..... 206/429; 206/434

[58] Field of Search ..... 206/429, 427, 206/434

[56] References Cited

U.S. PATENT DOCUMENTS

| | | | |
|---|---|---|---|
| 3,698,625 | 10/1972 | Graser | 206/434 |
| 3,945,560 | 3/1976 | Harrelson et al. | 206/434 |
| 4,184,626 | 1/1980 | Graser et al. | 206/434 |
| 4,382,505 | 5/1983 | Sutherland et al. | 206/427 |
| 4,453,664 | 6/1984 | Oliff | 206/434 |
| 4,574,997 | 3/1986 | Ikeda | 206/434 |
| 5,105,945 | 4/1992 | Carver | 206/434 |
| 5,246,112 | 9/1993 | Stout et al. | 206/427 |
| 5,360,104 | 11/1994 | Sutherland | 206/427 |
| 5,520,283 | 5/1996 | Sutherland | 206/427 |

*Primary Examiner*—Paul T. Sewell
*Assistant Examiner*—Nhan T. Lam

[57] ABSTRACT

An article carrier which tapers in toward the top panel on all four sides. The carrier in collapsed form is folded about an intermediate fold line in the bottom panel located so that the collapsed carrier is in flat folded condition. The provision of the intermediate fold line compensates for the greater width of the bottom panel compared to the width of the top panel. The sides of the carrier are squared by contact with the lower portions of bottles being through an open end of the carrier.

12 Claims, 4 Drawing Sheets

ARTICLE CARRIER WITH BOTTOM PANEL FALSE SCORE

FIELD OF THE INVENTION

This invention relates to a sleeve-type carrier for packaging articles such as beverage bottles. More particularly, it relates to a sleeve-type carrier having tapered sides.

BACKGROUND OF THE INVENTION

Sleeve-type carriers conventionally are manufactured from an elongated blank having a side panel section at one end and either the bottom panel section or the top panel section at the other end. The blank is formed into a flattened tube by folding the end sections in and adhering them to each other by a glue flap on one of the end sections. This flattened tube, or collapsed carrier as it is sometimes called, is then shipped to a packaging plant where it is erected into tube shape, filled with the articles being packaged and closed in at its ends. In the final form of carrier the fold line connecting the glue flap to the end section of the blank is a major fold line of the carrier, connecting one of the side panels to either the top or bottom panel.

When packaging bottles the end panels are often tapered inwardly toward the top panel to more closely conform to the shape of the bottles. To effect this design, the bottom panel is made longer than the top panel. This does not impact the manner in which the carrier is formed from the blank since the blank can still be folded in the manner described to create a collapsed carrier. This is possible because the length of the carrier corresponds to the width of the blank, so that the dimensions allowing the glue flap to meet with the opposite end section of the blank are not changed.

A different situation arises when producing a carrier incorporating tapered side panels. In such a case the width of the bottom panel is greater than the width of the top panel. Since this affects the length of the blank, if the blank were folded in the same manner as described the glue flap would not meet the opposite end section at the same location as in the previous case and the resulting tube would not be in flattened condition.

To overcome this problem the industry has employed a "false" score in the top or side panel of the carrier. The glue flap is glued to the opposite end section of the blank in the same manner as before, but instead of folding the blank about the score line which connects the glue flap to its panel section, it is folded about a score line in the top or side panel spaced from the glue flap fold line. However, when the resulting collapsed carrier is later erected at a packaging plant it tends to open at the false score rather than at the actual score. To make the carrier open at the proper score, either elements of the packaging machine or the incoming bottles themselves must push the side panels of the carrier into their final square condition. It is preferred to have the bottles carry out this function so that the packaging machine need not be made more complicated. This makes loading the bottles more difficult, however, since it is the upper less stable portions of the bottles that initially engage the side panels and push them into square condition. Moreover, by putting the false score in the top or side panels the score interrupts the panel surface in which it is located, which tends to disrupt the graphics appearing in this area of the carrier.

It would be highly desirable to provide a tapered carrier which does not require the use of a false score in the top or side panels, but which can nevertheless be loaded and squared up in a rapid, efficient manner. It is therefore an object of the invention to provide a carrier which meets these criteria. Another object is to provide a carrier which is not visually marred by use of a false score in the top or side panels.

BRIEF SUMMARY OF THE INVENTION

The invention is incorporated in a carrier whose bottom panel is wider than the top panel. To allow the carrier to be in flat folded condition when collapsed, the bottom panel is provided with an intermediate fold line which is substantially parallel to the side edges of the bottom panel and which divides the bottom panel into a minor portion and a major portion. The collapsed carrier is folded about the intermediate fold line, with the minor portion of the bottom panel lying substantially in the plane of one of the side panels and the major portion lying substantially in the plane of the other side panel.

When the collapsed carrier is opened during the packaging process the intermediate fold line is initially operative, causing the resulting carrier sleeve to assume an out-of-square condition. The carrier sleeve is squared by the bottles pushing the side panels into proper position as the bottles are inserted into the sleeve. Slits extending from the ends of the intermediate fold line to the nearest bottom panel fold line allow the bottom panel to be folded in this manner without extending the fold line into the end panel flaps connected to the bottom panel. Because the false score is in the bottom panel, it is not visible in the final package.

These and other features and aspects of the invention will be readily ascertained from the detailed description of the preferred embodiments described below.

DETAILED DESCRIPTION OF THE PREFERRED EMBODIMENTS

Figure 1:
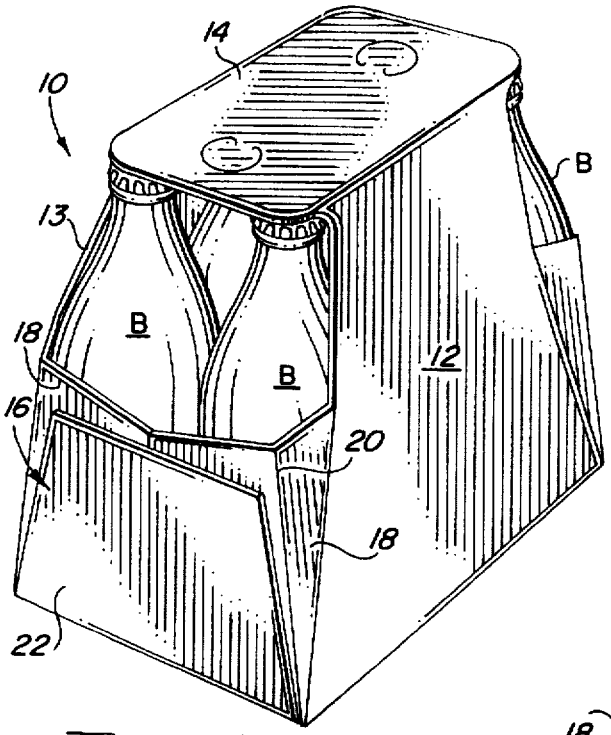
FIG. 1 is a pictorial view of a partially enclosed sleeve-type carrier incorporating the invention.
Figure 2:
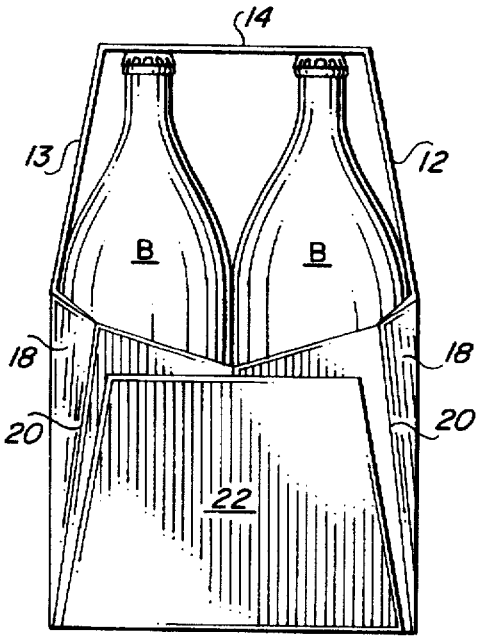
FIG. 2 is an end view of the carrier of FIG. 1.

Referring to FIGS. 1 and 2, the carrier 10 is a sleeve-type carrier designed to carry six beverage bottles B. It is comprised of opposite side panels 12 and 13 which are foldably connected to top panel 14 and to a bottom panel, not visible in these views. The carrier also includes partially open end panels 16 formed by dust flaps 18 which are folded in from the side panels and meet at the centerline of the carrier. An intermediate fold line 20 in the dust flaps allows the flaps to fold about the end bottles in the carrier in order to more tightly hold the bottles in place. An end panel flap 22 extends up from the bottom panel and is glued to the dust flaps to complete the end panel formation. As seen in FIG. 1, the bottom panel is longer than the top panel, and as best shown in FIG. 2, it is also wider than the top panel, enabling the wider body portions of the bottles to snugly fit in the lower portion of the carrier.

Figure 3:
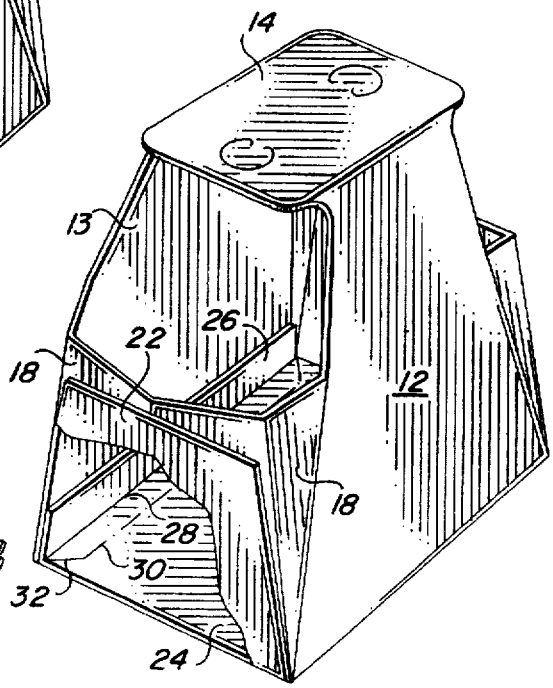
FIG. 3 is a partial pictorial view of the carrier with the bottles and the near end panel removed in order to show the interior.
Figure 4:
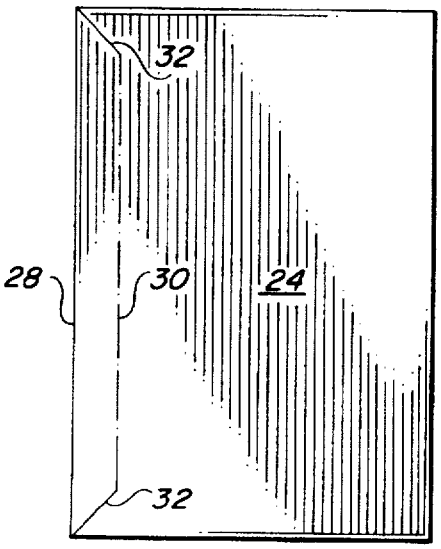
FIG. 4 is a bottom view of the carrier of FIG. 1.

As shown in FIG. 3, bottom panel 24 is connected to glue flap 26 by fold line 28 and the glue flap is adhered to the side panel 13. The fold line 28 thus foldably connecto the side panel 13 to the bottom panel. The bottom panel also includes false score 30, also referred to in the specification and claims as an intermediate fold line. As best shown in FIG. 4, the false score or fold line 30 is spaced from and parallel to the fold line 28, and is connected to the adjacent corners of the bottom panel 24 by diagonal slits 32.

Figure 5:
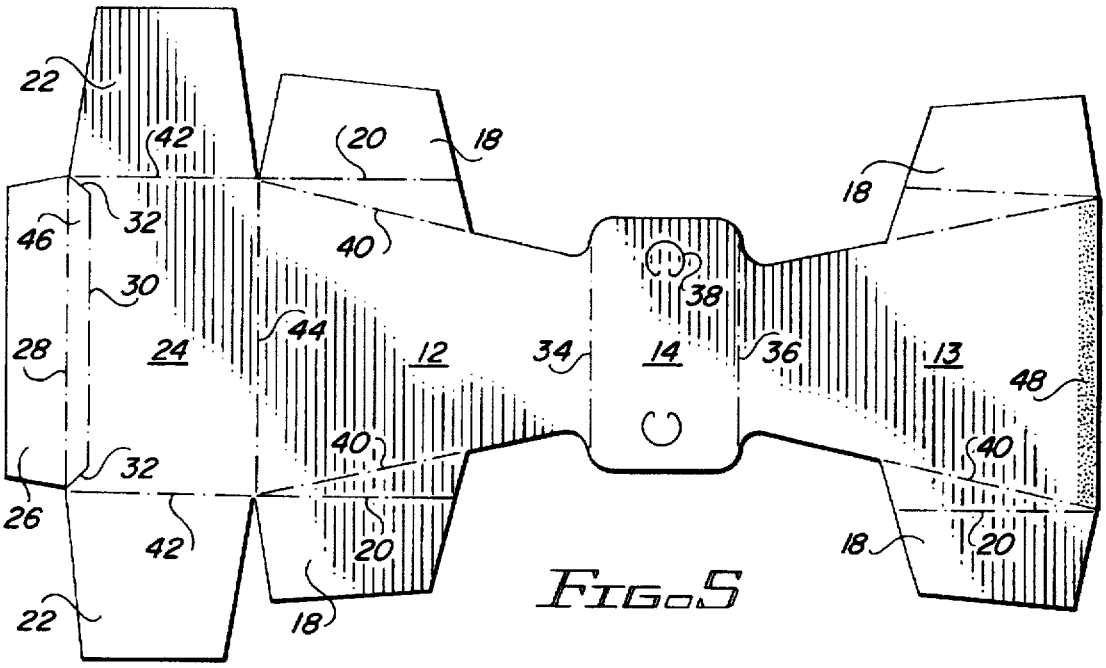
FIG. 5 is a plan view of a blank for fabricating the carrier of FIG. 1.

The blank from which the carrier is formed is shown in FIG. 5 to comprise top panel section 14 connected to side panel sections 12 and 13 by fold lines 34 and 36. Finger holes 38 in the top panel section serve as handle grips. The dust flaps 18 are connected to the side panel sections by fold lines 40, and the end panel flaps 22 are connected to the bottom panel section 24 by fold lines 42. In addition to the bottom panel section 24 being connected to the glue flap 26 by fold line 28, it is also connected to the side panel section 12 by fold line 44. The fold line 30 thus divides the bottom panel section into a minor portion, bounded by the fold line 28, the fold line 30 and the slits 32, and a major portion comprising the remainder of the bottom panel. The location of the fold 30 is dependent upon the difference in width between the top and bottom panels, and the angle of the slits 32 is a matter of choice, as explained below.

Figure 6:
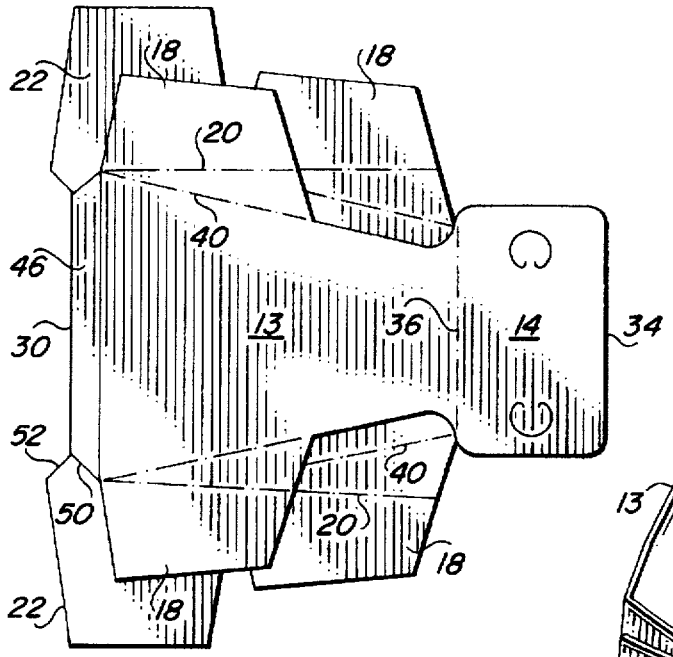
FIG. 6 is a plan view of a collapsed carrier formed from the blank of FIG. 5.

To form a flat collapsed carrier from the blank the glue flap 26 and the adjacent minor portion 46 of the bottom panel section are folded in about the intermediate fold line 30. Glue is then applied either to the glue flap 26 or to the stippled portion 48 at the end of side panel section 13, as shown in FIG. 5. The side panel section 13 and the top panel section 12 are then pivoted as a unit about the fold line 34 to bring the stippled portion 48 into contact with the glue flap, adhering these surfaces to each other. The resulting collapsed carrier is shown in FIG. 6. The bottom panel edges 50 and 52 formed by the slits 32 in the bottom panel section of the blank are separate and diverging at this point.

Figure 7:
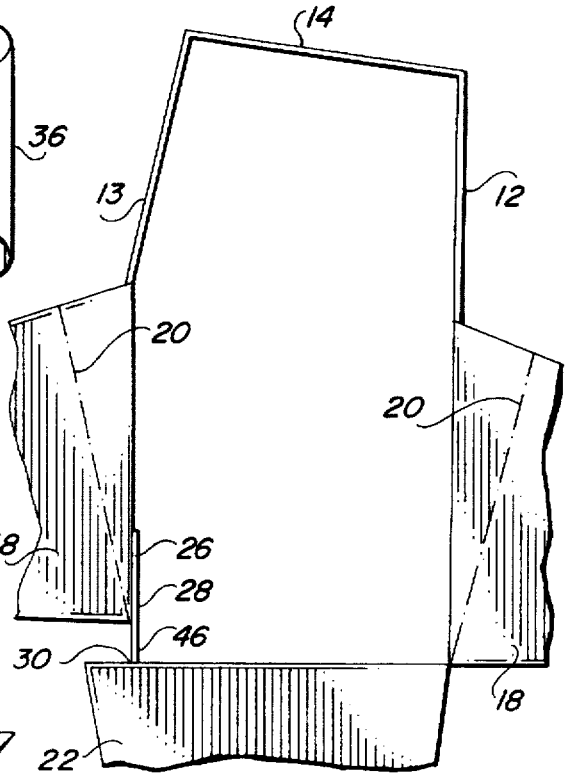
FIG. 7 is an end view of an erected open-ended carrier prior to loading it with bottles.

The collapsed carrier is erected to form a tube or sleeve by applying inward pressure to the folds 30 and 34 at the ends of the collapsed carrier, as is well known in the industry. As illustrated in FIG. 7, the erected carrier is not yet square because the fold line 30 is still operative, leaving the area 46 of the bottom panel in the same plane as the lower portion of the side panel 13. However, since the combined width of the bases of the two adjacent rows of bottles inserted into the sleeve is equal to the width of the bottom panel, the bottles themselves force the bottom panel portion 46 into the same plane as the rest of the bottom panel, making the fold line 28 the operative fold line between the side panel 13 and the bottom panel 24 as shown in FIG. 3. The edges 50 and 52 are therefore once again adjacent each other as shown in FIG. 4.

The actual location of the intermediate fold line in the bottom panel is determined by the widths of the top and bottom panels. To form a symmetrical carrier the intermediate fold line should be located a distance from the nearest bottom panel fold line equal to half the difference between the widths of the top and bottom panels.

As to the angle of the slits 32, it will be appreciated that they could theoretically be at right angles to the fold line 30, which would make them coincide with the bottom panel fold lines 42. However, this would have the undesirable effect of weakening the foldable connection between the end panel flaps 22 and the bottom panel 24. Therefore, it is preferred to angle the slits so that they are not so close to the fold lines 42 as to cause any significant weakening. An angle of 45° has been used in the example shown.

Figure 8:
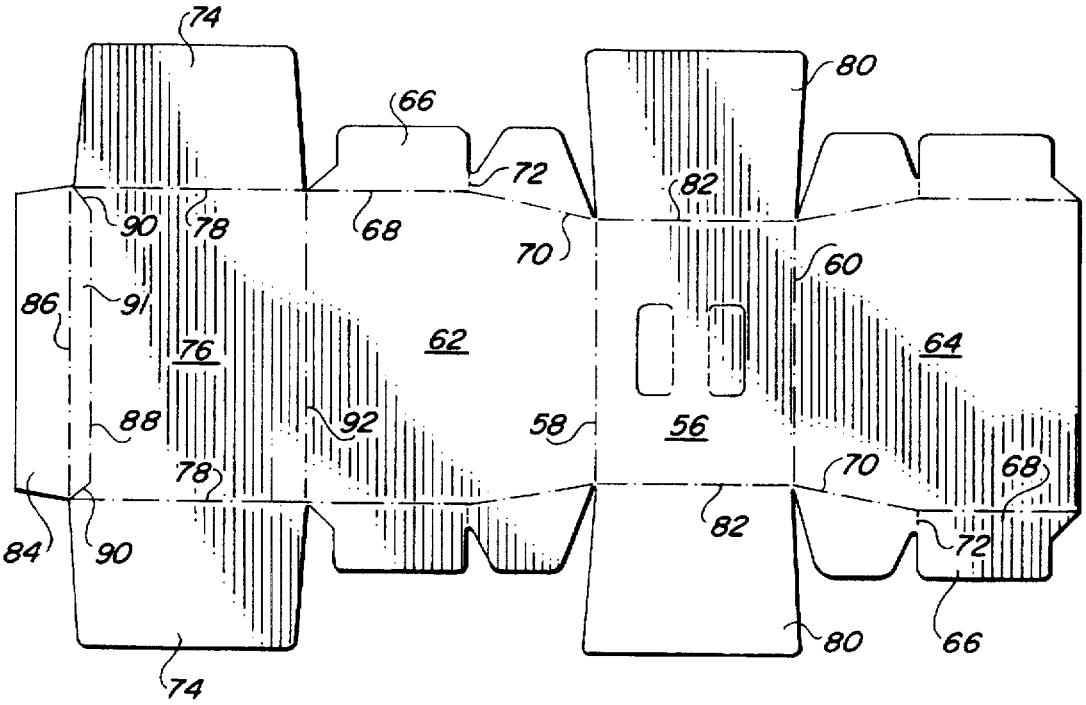
FIG. 8 is a plan view of a blank for forming another embodiment of the invention.

The invention is not limited to use with a partially open-ended carrier of the type illustrated in FIGS. 1–7, but may be incorporated in other sleeve-type carrier designs as well. The blank shown in FIG. 8, for example, is designed to form a fully enclosed carrier for receiving twelve bottles arranged in three rows of four bottles each. The blank is similar in basic layout to conventional blanks for forming enclosed carriers, comprising top panel section 56 connected by fold lines 58 and 60 to side panel sections 62 and 64. Each side panel section is connected to opposite dust flaps 66 by converging fold lines 68 and 70. A score line 72 in the dust flaps at the juncture of the fold lines 68 and 70 allows the upper portion of the dust flaps to fold in about the fold line 70 against the neck of an adjacent bottle. End panel flaps 74 are connected to the bottom panel section 76 by fold lines 78 as in the first embodiment, but in this embodiment end panel flaps 80 are also provided, being connected to the top panel section 56 by fold lines 82. As in the first embodiment a glue flap 84 is connected to the bottom panel section by fold line 86 and a false score or intermediate fold line 88 in the bottom panel section is connected to the fold lines 78 by the slits 90 to form bottom panel minor portion 91. The bottom panel section is also connected to the side panel section 62 by fold line 92.

Figure 9:
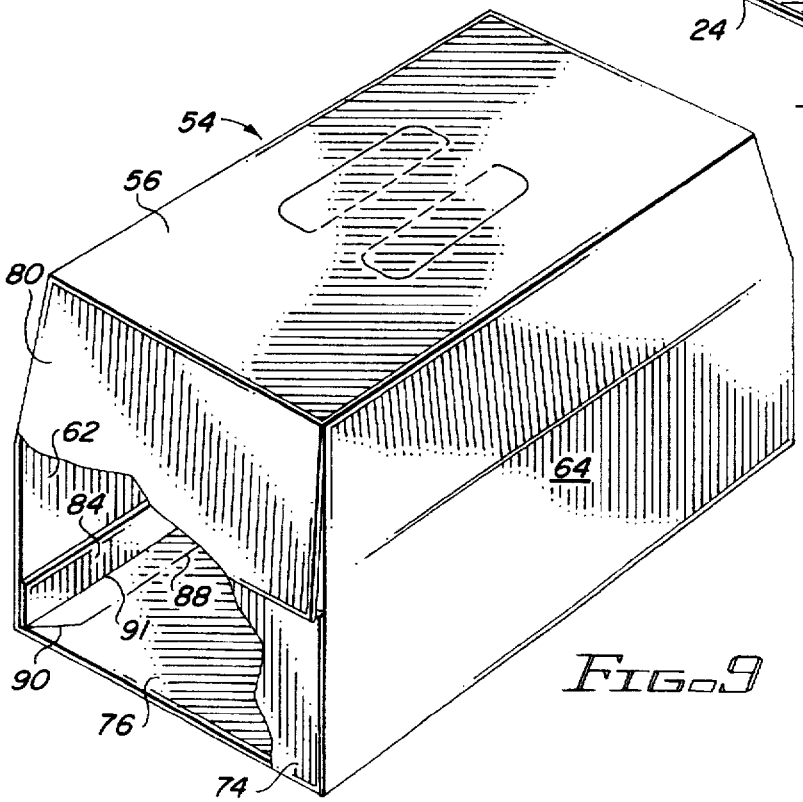
FIG. 9 is a partial pictorial view of a fully enclosed carrier formed from the blank of FIG. 8.

The process of forming a package from the blank is the same as described in connection with the first embodiment. The resulting carrier, without the bottles showing, is illustrated in FIG. 9 as having the false score line 88 in the bottom panel. As in the carrier of the first embodiment, the initially out-of-square erected carrier is squared up by being pushed into place by the base of the bottles as they enter the carrier tube.

Figure 10:
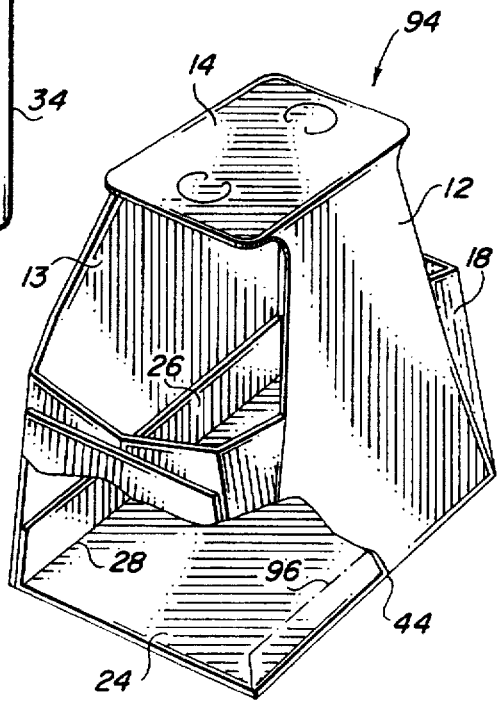
FIG. 10 is a partial pictorial view of a carrier similar to the carrier of FIG. 1, but incorporating a modified form of the invention.

Another embodiment of the invention is shown in FIG. 10 to be a partially open-ended carrier 94 similar to the carrier 10 of FIG. 3. In carrier 94, however, the intermediate fold line 96 is spaced a short distance from the fold line 44 rather than a short distance from the fold line 28.

Figure 11:
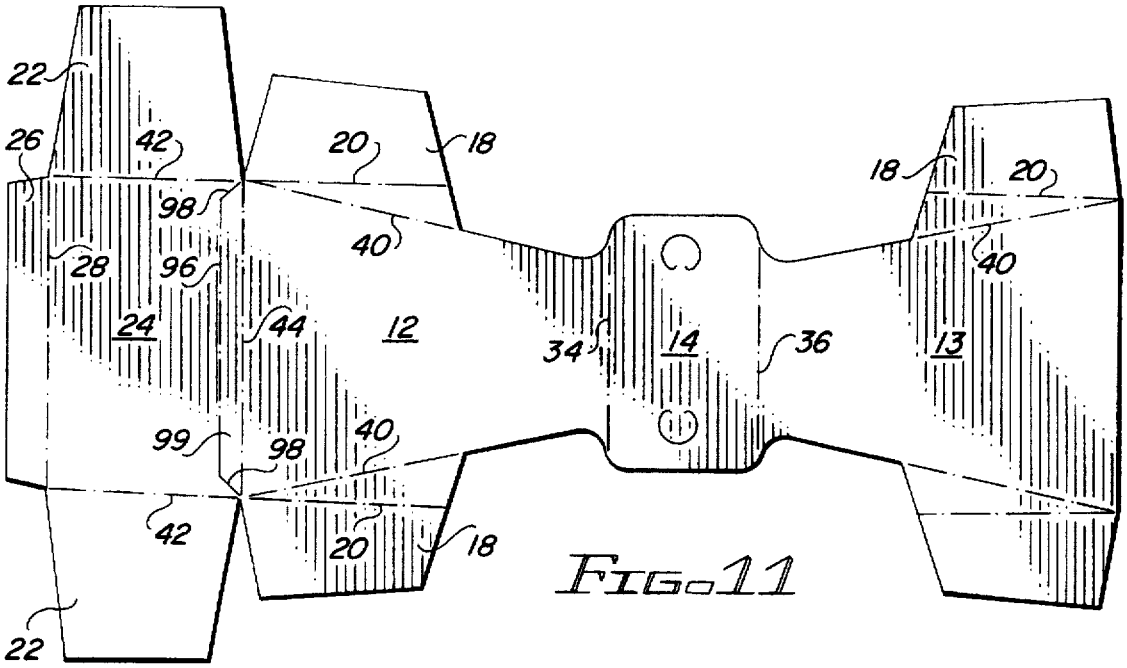
FIG. 11 is a plan view of a blank for forming the carrier of FIG. 10.
Figure 12:
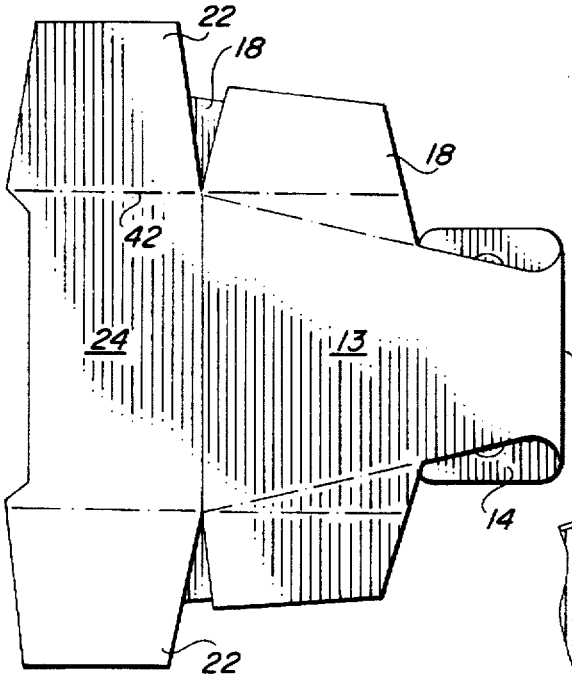
FIG. 12 is a plan view of a collapsed carrier formed from the blank of FIG. 11.

The carrier 94 is formed from the blank shown in FIG. 11, wherein like reference numerals to those used in FIG. 5 denote similar elements. It can be seen that the intermediate fold line or false score line 96 is connected to the ends of fold line 44 by the diagonal slits 98 to form minor bottom panel portion 99. To form a collapsed carrier the bottom panel section 24 is folded about the fold line 96. Glue is applied to the glue flap 26 or to the end portion of the side panel section 13, after which the side panel section 13 is folded in about the fold line 36. This places the end portion of the side panel section 13 in contact with the glue flap 26, adhering them together. The resulting collapsed carrier is shown in FIG. 12. It will be appreciated that the collapsed carrier is similar in appearance to the reverse side of the collapsed carrier of FIG. 6. This embodiment, therefore, results in the same type of carrier as the carrier of FIG. 1, but requires a different folding procedure to be employed to form a flat collapsed carrier. The unfolding of the intermediate fold line 96 takes place in the same manner as in the previous embodiments, by the bases of the incoming bottles forcing the lower portions of the side panels into a square relationship with the bottom panel. As in the other embodiments, in order to produce a 10 symmetrical carrier the intermediate fold line is spaced a distance from the nearest bottom panel fold line equal to half the difference in widths between the top and bottom panels.

Although the carrier has been described in connection with a sleeve-type carrier for packaging bottles, it will be understood that it may be used to package other types of tapered articles as well. The ability to use the base of the articles to force the erected carrier into square condition makes for a more stable process and makes it easier to introduce articles into the carrier. Also, the location of the false score in the bottom panel has no visual impact, thereby not interfering with any graphics printed on the side or top panels.

It will be understood that the invention is not limited to all the specific details described in connection with the preferred embodiments, except as they may be within the scope of the appended claims, and that changes to certain features of the preferred embodiments which do not alter the overall basic function and concept of the invention are contemplated.

What is claimed is:

1. An article carrier of the type formed from a collapsed carrier sleeve, comprising:

opposite side panels connected to opposite side edges of a top panel and to opposite side edges of a substantially planar bottom panel, the side edges of the top and bottom panels being substantially parallel;

opposite end panels connected to the side panels and the bottom panel;

the bottom panel having a greater width than the width of the top panel; and the bottom panel including an intermediate fold line substantially parallel to the side edges of the bottom panel, the intermediate fold line being spaced from one of the side edges of the bottom panel by an amount substantially equal to half the difference between the width of the bottom panel and the width of the top panel, whereby the bottom panel and the side panels connected to said one side edge of the bottom panel can be folded about said intermediate fold line in a collapsed carrier sleeve from which the carrier is erected so as to be in substantially face-to-face contact in such a collapsed carrier sleeve.

2. An article carrier as defined in claim 1, wherein the bottom panel is connected to one of the side panels by a glue flap.

3. An article carrier as defined in claim 1, wherein each end panel is comprised of inwardly folded dust flaps connected to the opposite side panels and an upwardly folded end panel flap connected to the bottom panel, the end panel flap being adhered to the dust flaps.

4. An article carrier as defined in claim 3, wherein each end panel further includes a downwardly folded end panel flap connected to the top panel, the downwardly folded end panel flap being adhered to the upwardly folded end panel flap.

5. An article carrier as defined in claim 1, wherein the bottom panel has a length greater than the length of the top panel.

6. An article carrier as defined in claim 1, wherein the intermediate fold line has opposite ends, the bottom panel including a slit extending from each end of the intermediate fold line to said one side edge of the bottom panel.

7. An article carrier as defined in claim 6, wherein the slits extend diagonally to said one side edge of the bottom panel.

8. A blank for forming an article carrier having a substantially planar bottom panel, the article carrier being of the type formed from a collapsed carrier sleeve, comprising:

a top panel section having opposite side edges;

a side panel section connected to each side edge of the top panel section by a fold line;

a bottom panel section having opposite side edges, one of the side edges being connected to one of the side panel sections by a fold line;

the bottom panel section having a greater width than the width of the top panel section;

the aforesaid side edges and the aforesaid fold lines being substantially parallel to each other; and the bottom panel section including an intermediate fold line substantially parallel to the side edges of the bottom panel section, the intermediate fold line being spaced from one of the side edges of the bottom panel section by an amount substantially equal to half the difference between the width of the bottom panel section and the width of the top panel section, whereby the bottom panel section and the side panel section connected to said one side edge of the bottom panel section can be folded about said intermediate fold line in a collapsed carrier sleeve formed from the blank so as to be in substantially face-to-face contact therein.

9. A blank as defined in claim 8, wherein the bottom panel section and each side panel section have opposite end edges, each end edge of the side panel sections being connected by a fold line to a dust flap, each end edge of the bottom panel section being connected by a fold line to an end panel flap.

10. A blank as defined in claim 9, wherein the top panel section has opposite end edges, each end edge of the top panel section being connected by a fold line to an end panel flap.

11. A blank as defined in claim 8, wherein the intermediate fold line has opposite ends, the bottom panel section including a slit extending from each end of the intermediate fold line to said one side edge of the bottom panel section.

12. A blank as defined in claim 11, wherein the slits extend diagonally to said one side edge of the bottom panel section.

* * * * *